US007661679B2

(12) United States Patent
Mah et al.

(10) Patent No.: US 7,661,679 B2
(45) Date of Patent: Feb. 16, 2010

(54) ELECTRONIC TARGET SYSTEM FOR SPORTS

(76) Inventors: Ernest Wing Mah, 135 Winston Castle Drive, Markham, Ontario (CA) L6C 2N4; Richard Mah, 135 Winston Castle Drive, Markham, Ontario (CA) L6C 2N4

( * ) Notice: Subject to any disclaimer, the term of this patent is extended or adjusted under 35 U.S.C. 154(b) by 59 days.

(21) Appl. No.: 11/562,414

(22) Filed: Nov. 22, 2006

(65) Prior Publication Data

US 2007/0184920 A1 Aug. 9, 2007

Related U.S. Application Data

(60) Provisional application No. 60/738,508, filed on Nov. 22, 2005.

(51) Int. Cl.
*F41J 5/00* (2006.01)
*A63B 69/00* (2006.01)

(52) U.S. Cl. ..... 273/371; 473/446

(58) Field of Classification Search ..... 273/398–402, 273/371; 473/446

See application file for complete search history.

(56) References Cited

U.S. PATENT DOCUMENTS

| | | | | |
|---|---|---|---|---|
| 3,970,310 | A * | 7/1976 | Gryschuk | 273/375 |
| 4,245,843 | A | 1/1981 | Griggs | |
| 4,607,842 | A * | 8/1986 | Daoust | 473/446 |
| 4,763,903 | A * | 8/1988 | Goodwin et al. | 273/371 |
| 4,826,166 | A * | 5/1989 | Baker et al. | 473/439 |
| 5,634,640 | A * | 6/1997 | McCarrel | 473/446 |
| 5,725,444 | A | 3/1998 | Heden | |
| 5,888,153 | A * | 3/1999 | Masin | 473/446 |
| 5,895,330 | A | 4/1999 | Reilly, Jr. | |
| 5,988,645 | A * | 11/1999 | Downing | 273/348 |
| 5,988,646 | A | 11/1999 | Fair | |
| 5,993,334 | A | 11/1999 | McNamara | |
| 6,554,284 | B2 | 4/2003 | Chou | |
| 6,692,384 | B2 | 2/2004 | Bains | |
| 6,695,724 | B2 | 2/2004 | Birss | |
| 6,736,739 | B1 | 5/2004 | Epworth | |
| 6,811,501 | B2 | 11/2004 | Kuzia et al. | |
| 6,837,495 | B2 | 1/2005 | Gerson et al. | |
| 6,926,624 | B1 * | 8/2005 | Witzke | 473/446 |
| 7,134,976 | B1 * | 11/2006 | Smith | 473/446 |
| 7,166,045 | B1 * | 1/2007 | Linner et al. | 473/446 |
| 2002/0042312 | A1 * | 4/2002 | Decloux | 473/476 |
| 2003/0030218 | A1 * | 2/2003 | Zucchi et al. | 273/371 |
| 2003/0175668 | A1 * | 9/2003 | Thornley et al. | 434/252 |

* cited by examiner

*Primary Examiner*—Mark S Graham

(57) ABSTRACT

Sports shooting target assembly that electronically detects successful shots through the aperture of the target frame. One or more target assemblies are attached to a goal post or cross-bar in desired practice locations. The target assemblies are electronically controlled by a central unit to form a sports shooting practice system. In one embodiment, a microcontroller is programmed to control the target assemblies and provide a number of entertaining games. Other embodiments add lights to each target assembly and a siren to provide feedback on successful shots through the target assembly's aperture.

8 Claims, 7 Drawing Sheets

ELECTRONIC TARGET SYSTEM FOR SPORTS

CROSS-REFERENCE TO RELATED APPLICATIONS

This application claims the benefit of provisional patent application Ser. No. US60/738,508, filed Nov. 22, 2005 by the present inventors.

FEDERALLY SPONSORED RESEARCH

Not Applicable.

SEQUENCE LISTING OR PROGRAM

Not Applicable.

BACKGROUND OF THE INVENTION

1. Field of Invention

This invention generally relates to the field of sports, specifically to a training aid to improve a player's accuracy in directing a projectile.

2. Prior Art

There are many sports that exist where one of the objects of the game is to accurately shoot an object into a goal past a defender. Hockey is one such sport where a goal is scored when the player shoots a puck (or ball) into the opposing net past a goaltender. A skill that the player needs to develop is an accurate shot typically near the corners of the net to put the puck (or ball) past the goaltender.

An example of prior art include the Hockey Practice System by Witzke, U.S. Pat. No. 6,926,624 (2005). Here a large panel with size equivalent to the goal is created with a series of cutouts across the entire surface. Each of the cutouts holds a piece of flexible material (e.g. foam) that is designed to be dislodged by a shot to the area of the cutout. Some of the problems with this design:

- The locations of cutouts near the middle of the panel are not typically good locations for the player to shoot at, as the goaltender would protect the middle of the goal quite well.
- After the foam is dislodged to signify that a shot has penetrated that location, another shot at that location will not be detected, unless the player reinserts the foam piece. This is very time consuming and disrupts the player's concentration on developing his shooting skill.
- The shape of the apparatus does not resemble the true hockey net that the player will face in a real game. Shooting at a proper net helps develop the skill in a more realistic fashion.

Another example of prior art is found in Hockey Target by Griggs, U.S. Pat. No. 4,245,843 (1981). Here, circular targets are affixed to the corners of a real hockey net, again with flexible material inserted into each target. These are located in the prime shooting locations which help develop good shooting skills. It is also mounted on a real net, so will provide the shooter with a realistic situation while developing their skills. Some of the problems with this design:

- As with the Hockey Practice System above, once the foam is dislodged, the player can no longer shoot at that location.
- As there are only four targets in that design, play is disrupted much quicker than the Hockey Practice System.

Heden, U.S. Pat. No. 5,725,444 (1998) describes a device for training soccer players having a rectangular net body and a plurality of pockets. The rectangular net body and pockets are made of flexible net material. The rectangular net body has a plurality of apertures. Each pocket is attached to the perimeter of each aperture and sized to receive at least one soccer ball. This design does not require replacing an object back that has been dislodged as in the previous examples of prior art, but once the pocket is filled with the object being shot, play is disrupted until the pocket is emptied. The structure is also required to be as large as the opening of the goal and prevents the natural path of the projectile to be seen when it is caught by either the pocket or the larger netting.

Masin, U.S. Pat. No. 5,888,153 (1999) describes a portable target that can be connected to a fixed object such as the frame of a hockey net. The target is a band of steel or other sturdy material and of any desired shape. A pocket is connected to the perimeter of the target for catching a hockey puck, ball or other object which is directed through the perimeter of the target. The target is attached to the goal with a spring loaded clamping device. This design again has no object that requires replacing, but play is disrupted once the shooter runs out of projectiles as it is caught in the pocket. Over time, the pocket material may get weak and break requiring repair.

Reilly, Jr., U.S. Pat. No. 5,895,330 (1999) describes a modified sports goal that is adapted for training a sports player to direct objects into preferred target areas. A modified goalpost frame is formed in the shape of a preferred target area of a standard sports goal. A net is coupled to the goalpost frame. The goalpost and net capture objects, such as hockey pucks, directed into the preferred target area, and allow misdirected objects which otherwise would have been captured by the standard sports goal to pass thereby. In this manner, a participant is rewarded with the feeling of achieving a goal only if the object enters the target areas. Otherwise, the object passes by the goal. This goal reduces the need for goaltenders during practice sessions, mitigating the possibility of goaltender injury and improving the shooter's ability to develop skills. This design's disadvantage is that it requires the use of a custom designed goal frame and cannot make use of an existing net. The alternative design of the frame also does not provide the same visual reference as a proper net for the shooter during practice. The entire assembly itself is not easily portable.

SUMMARY

In accordance with one embodiment targets utilizing an active infrared detection mechanism are controlled with a microchip to provide an interactive sports shooting practice system.

DRAWINGS—FIGURES

DRAWINGS—REFERENCE NUMERALS

Figure 1:
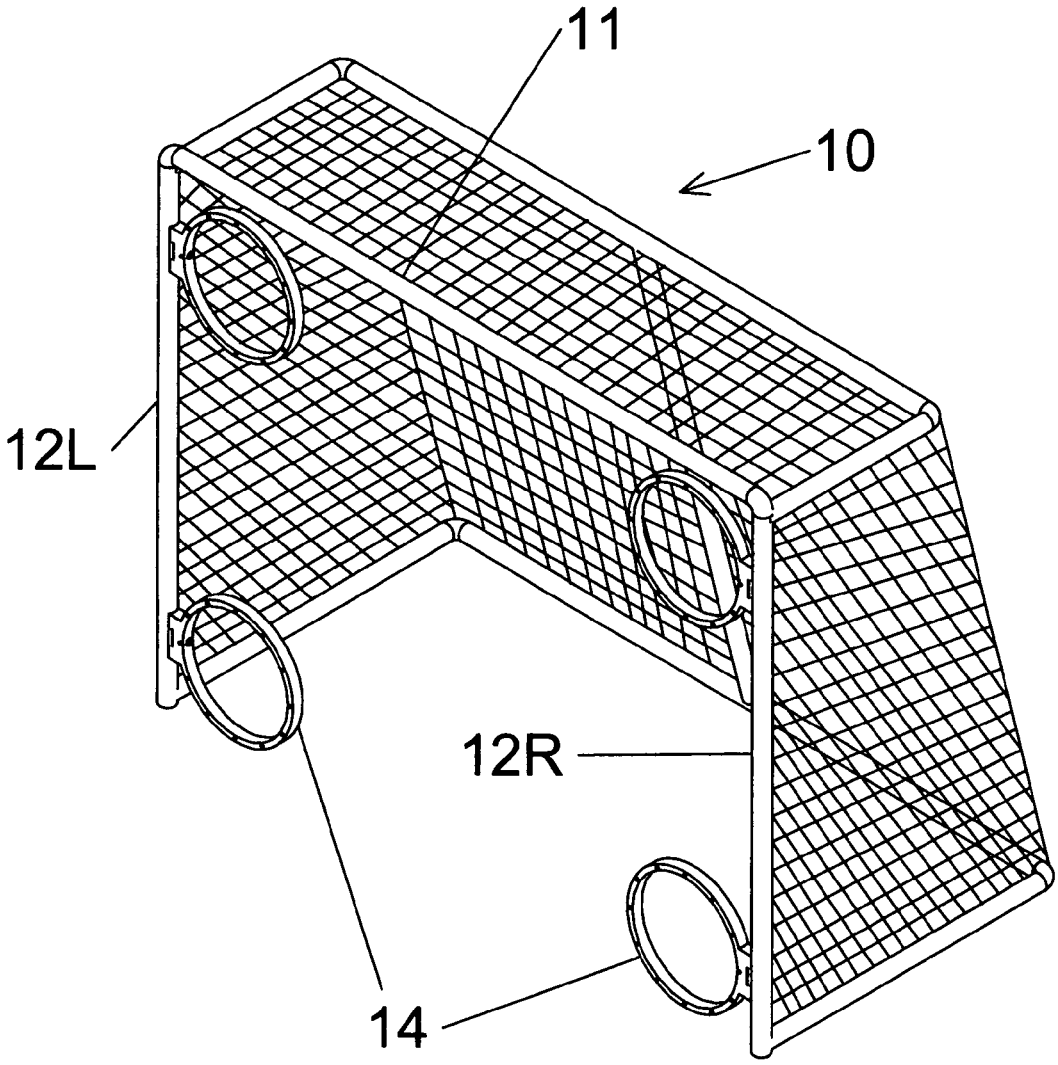
FIG. 1 shows an overall view of one embodiment with four target assemblies mounted on a hockey net.

10 hockey goal crossbar
11 crossbar
12L left vertical post
12R right vertical post
14 target frame
15 outward face of target frame
16 infrared receiver module
18 infrared light emitting diode (LED)
19 slit
20 green light emitting diode (LED)
21 strap device
22 red light emitting diode (LED)
23 target inner side wall
24 hockey puck
26 main control unit
27 exterior
28 wires
29 front face
30 display device
32 on/off switch
34 game selector switch diode (LED)
36 batteries
38 microchip
40 alternative target frame
42 focused infrared light emitting
43 infrared beam
44 speaker

DETAILED DESCRIPTION—FIRST EMBODIMENT—FIGS. 1, 2, 3, 4

One embodiment of the sports shooting practice system is illustrated in FIG. 1. Four targets 14 are mounted on a hockey net 10. Two targets 14 are on the left vertical post 12L and two targets 14 on the right vertical post 12R. This is a typical arrangement of four targets 14, but is not limited to four. Alternatively, there could be more than four targets 14 in total and they could be mounted on the horizontal crossbar 11 in addition to the vertical posts 12.

Figure 2:
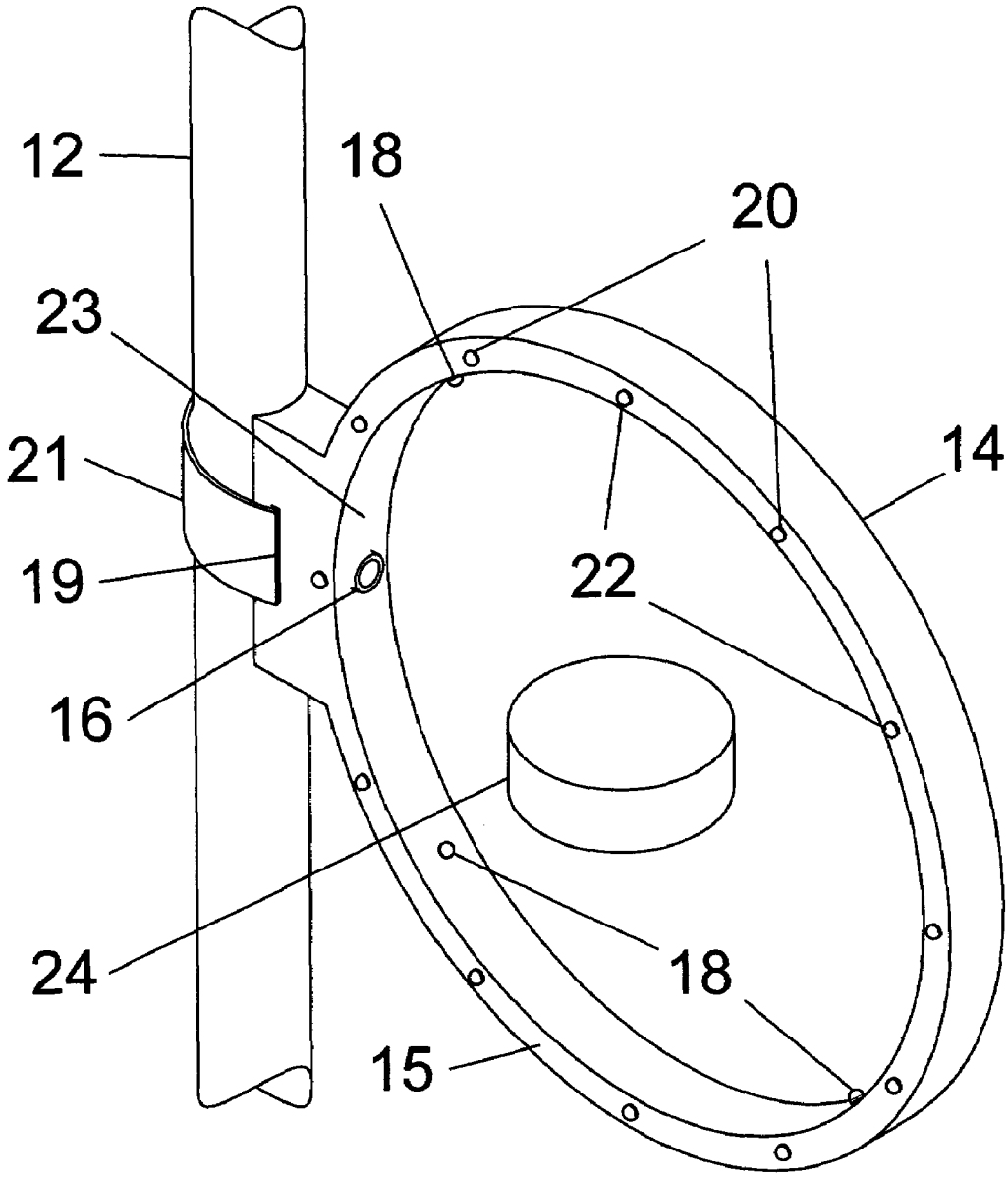
FIG. 2 shows a close up view of one target assembly with components for object detection and visual feedback.

An individual target 14 is illustrated in FIG. 2. In the preferred embodiment the target 14 is circular, roughly 12 inches (30.5 cm) in diameter. The shape of the target 14 can be made from but not limited to molded impact-resistant plastic. One part of the target 14 extrudes outwards to provide space for a slit 19. The target 14 is held in place by a strap 21 going through the slit 19 in the target 14 and wrapping around the post 12. The strap 21 can be a hook-and-loop fastener (Velcro), or some other appropriate strap device. Red 22 and green 20 light emitting diodes (LEDs) are mounted in alternating fashion on the outward face 15 of the target 14, facing the shooter. Infrared emitting diodes 8 are mounted on the inner side wall 23 of the target 14. An infrared receiver module 16 is mounted on the inner side wall 23 facing the area bounded by the target 14. The inner side wall 23 of the target 14 can be optionally coated with infrared absorbent material. A puck 24 is shown passing through the aperture of the target 14.

Figure 3:
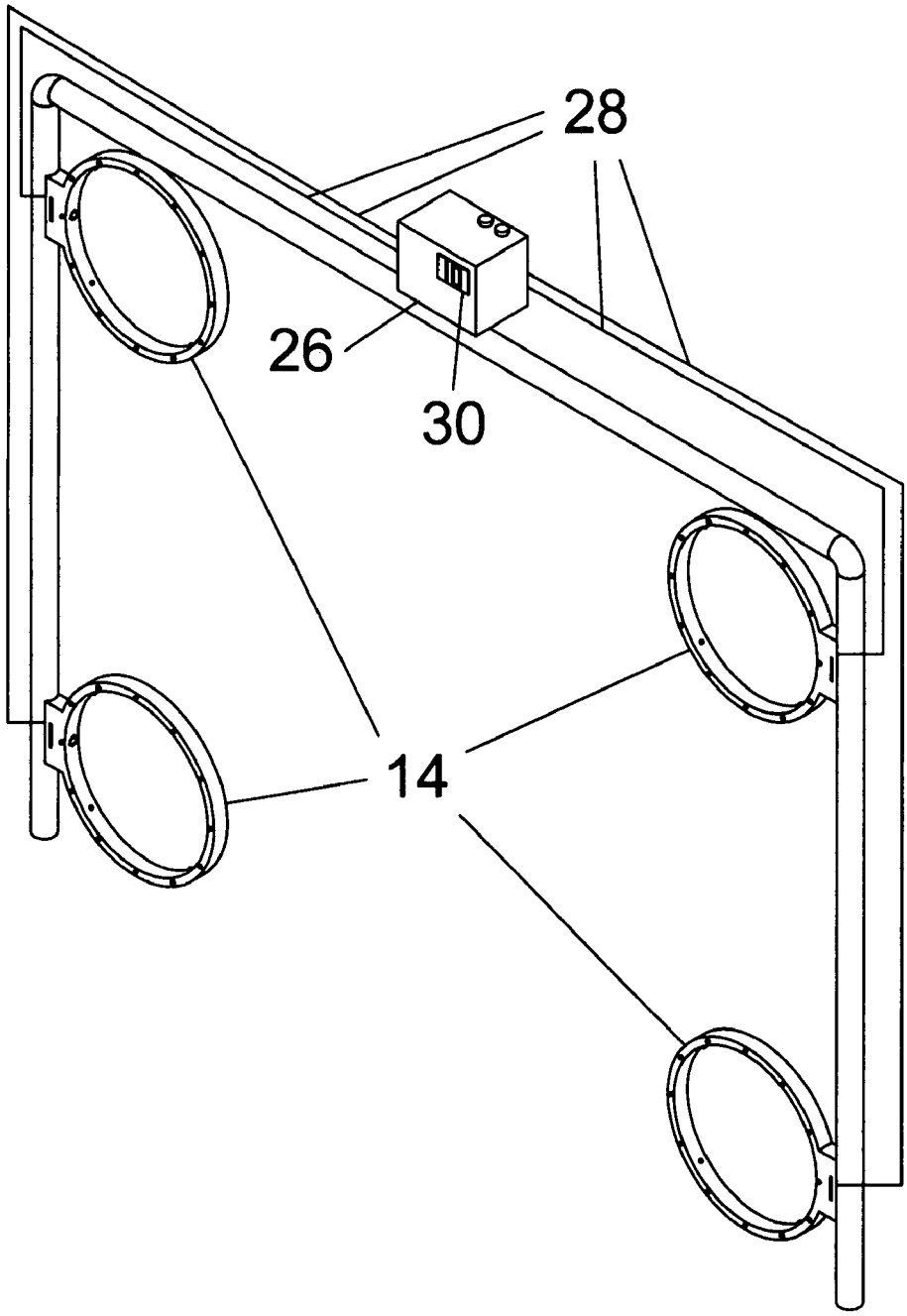
FIG. 3 shows four target assemblies linked together to a main control unit.
Figure 4:
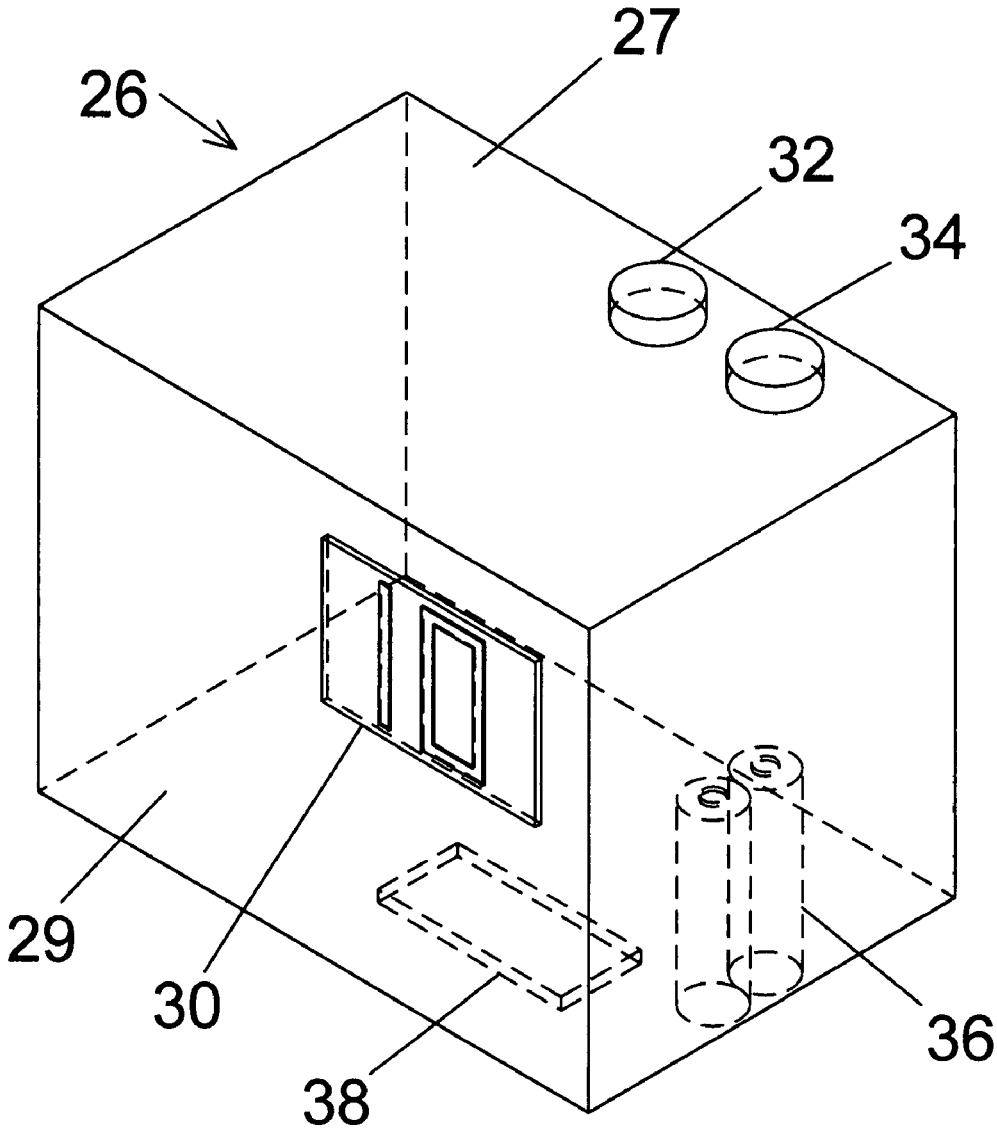
FIG. 4 shows the main control unit containing a display, buttons, battery and microchip.

Each target 14 is connected to the main control unit 26 by a set of wires 28 as shown in FIG. 3. The main control unit 26 can be mounted on the hockey goal 10, or remotely located. The main control unit 26 consists of several components as shown in FIG. 4. The display device 30 is mounted on the front face 29 of the main control unit 26 so that the display is visible to the shooter. The on/off switch 32 and game selector switch 34 are mounted on the exterior 27 of the main control unit 26 so that they can be operated by the player. The batteries 36 and the microchip 38 reside inside of the main control unit 26.

Operation—First Embodiment—FIGS. 1, 2, 3, 4

The target 14 is a circular frame that serves several purposes:

1. Defines an area for the player to attempt to shoot the puck 24 through
2. Provides visual feedback to the player as to the status of the target 14
   a. target 14 is on and is ready to be shot at (green 20 LEDs light up)
   b. target 14 has been scored on (green 20 and red 22 LEDs light up in alternating fashion)
   c. target 14 is off (all green 20 and red 22 LEDs are off)
3. Houses the detection mechanism for determining if a successful shot through the target 14 has been taken.

As shown in FIG. 2, a series of alternating red 22 and green 20 LEDs are mounted on the outward facing surface 15 of the target 14. The microchip 38 turns the green LEDs 20 of the target 14 on to identify that the target 14 is active. An active target 14 is ready to be shot at with the puck 24. The microchip 38 turns off the green LEDs 20 of a target 14 if the target 14 is inactive and should not be shot at. After the microchip 38 detects a voltage drop in the infrared receiver module's 16 feedback pin, the microchip 38 will cause the red 22 and green 20 LEDs to flash in alternating sequence. A suggested time delay is 250 ms for green, followed by 250 ms for red, alternating for a total suggested time of 3 seconds.

The detection mechanism is based on an active infrared system. Setting up a microchip 38 to transmit the appropriate frequency to the infrared LEDs 18 and also using the microchip 38 to react when infrared is detected by the infrared receiver module 16 will be easy for someone skilled in the electronic arts. When the target 14 is on, the set of infrared LEDs 18 are activated by the microchip 28 to emit infrared light to cover the entire target 14 aperture. When the puck 24 passes through the target 14, infrared is reflected off the puck 24 and back towards an infrared receiver module 16 that is designed to react to the frequency of infrared that is emitted by the LEDs 18. Care must be taken with the placement and the angle of the infrared LEDs 18 to ensure that infrared is not inadvertently projected into the infrared receiver modules 16 of the other targets 14. To prevent the inner side wall 23 of the target 14 from reflecting the infrared light when there is no puck 24 in the target aperture, the entire inner side wall 23 of the target 14 can be coated with an infrared absorbing substance (e.g. flat black paint) or the entire target 14 can be molded from infrared absorbing material.

This same detection mechanism is repeated in each target 14. All four targets 14 are connected to the main control unit 26 and controlled by the microchip 38 through four sets of wires 28 as shown in FIG. 3. These wires 28 provide power to the red 22, green 22, and infrared 18 LEDs. The wires also connect the infrared receiver module 16 to the microchip 38. The microchip 38 determines when the target 14 should be on, whether more than one target 14 should be on, etc. This gives enormous flexibility in providing a series of interactive games. Here are some examples, but not limited to:

1. Shootout style—all targets 14 are on and the shooter has a fixed amount of time to attempt to score once on all four targets 14.

2. Random—targets 14 turn on at random, simulating a real game situation where the shooter has to react and shoot at certain changing openings provided by the goalie.
3. All on—all targets 14 are on. Once scored upon, they flash to indicate scoring, but will reset and turn on again. The user needs to score on as many targets 14 as possible in an allotted time.
4. Consecutive—targets 14 are activated one at a time in a predictable fashion. Each target 14 remains on until a successful shot is received.

The display device 30 provides different information to the player. On initial startup of the microchip 38, the currently selected game is displayed. The player can change the game they wish to play by pressing and releasing the game selector switch 34. If no change in the game selector switch 34 is detected after a short pause since the last change in game, a small delay commences allowing the shooter to set up and be ready to start shooting. Once the game begins, the display device 30 will show the running total of goals that have been scored into any of the active targets 14. If the game chosen has a fixed time, the display 30 will switch to show the remaining number of seconds when 10 seconds or less remain. Upon completion of the game, the total goals will be displayed. The player can restart the game by pressing and releasing the game selector switch 34.

The microchip controller 38 is a standard chip containing ROM and a suitable embedded program (PROM) arranged to function as described above in infrared light emission, detection, green 20 and red 22 LED control, as well as controlling the game behavior.

FIG. 4 shows the main control unit 26 with a display device 30, on/off switch 32, and game selector switch 34. The battery 36 and microchip 38 are contained in the interior of the control unit 26.

Figure 5:
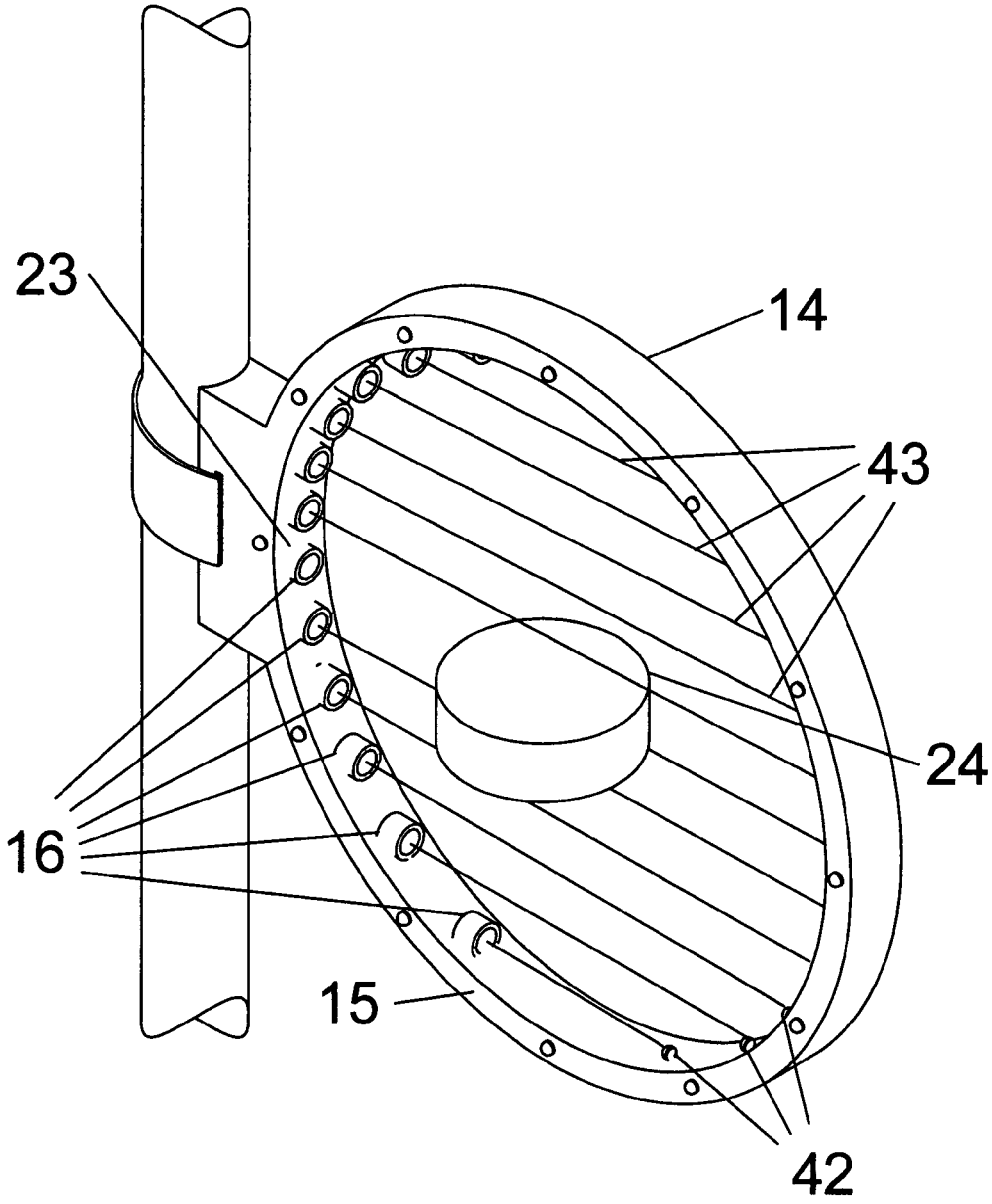
FIG. 5 shows an alternate embodiment using a set of infrared light emitting diodes and corresponding receiver modules to create parallel infrared detection beams.

Description—Alternative Embodiment—FIG. 5

FIG. 5 is a close up of a single target 14 using alternative positioning of focused infrared LEDs 42 and infrared receiver modules 16. Focused infrared LEDs 42 are positioned on the inner side wall 23 of the target 14 along one side. On the opposing side to the focused infrared LEDs 42 are infrared receiver modules 16. Each focused infrared LED 42 points to a single opposing infrared receiver module 16 to create an infrared beam 43.

Operation—Alternative Embodiment—FIG. 5

The detection mechanism used in each target 14 can also be achieved by projecting a series of parallel infrared beams 43 across the target 14 aperture from the focused infrared LEDs 42. The infrared beams 43 should be equally spaced apart such that the distance between each beam is smaller than the narrowest dimension of the puck 24. When any of the beams 43 are broken, this will cause a voltage change in the infrared receiver module 16. The microchip's 38 logic can detect this change and register it as a successful shot through the target 14.

Figure 6:
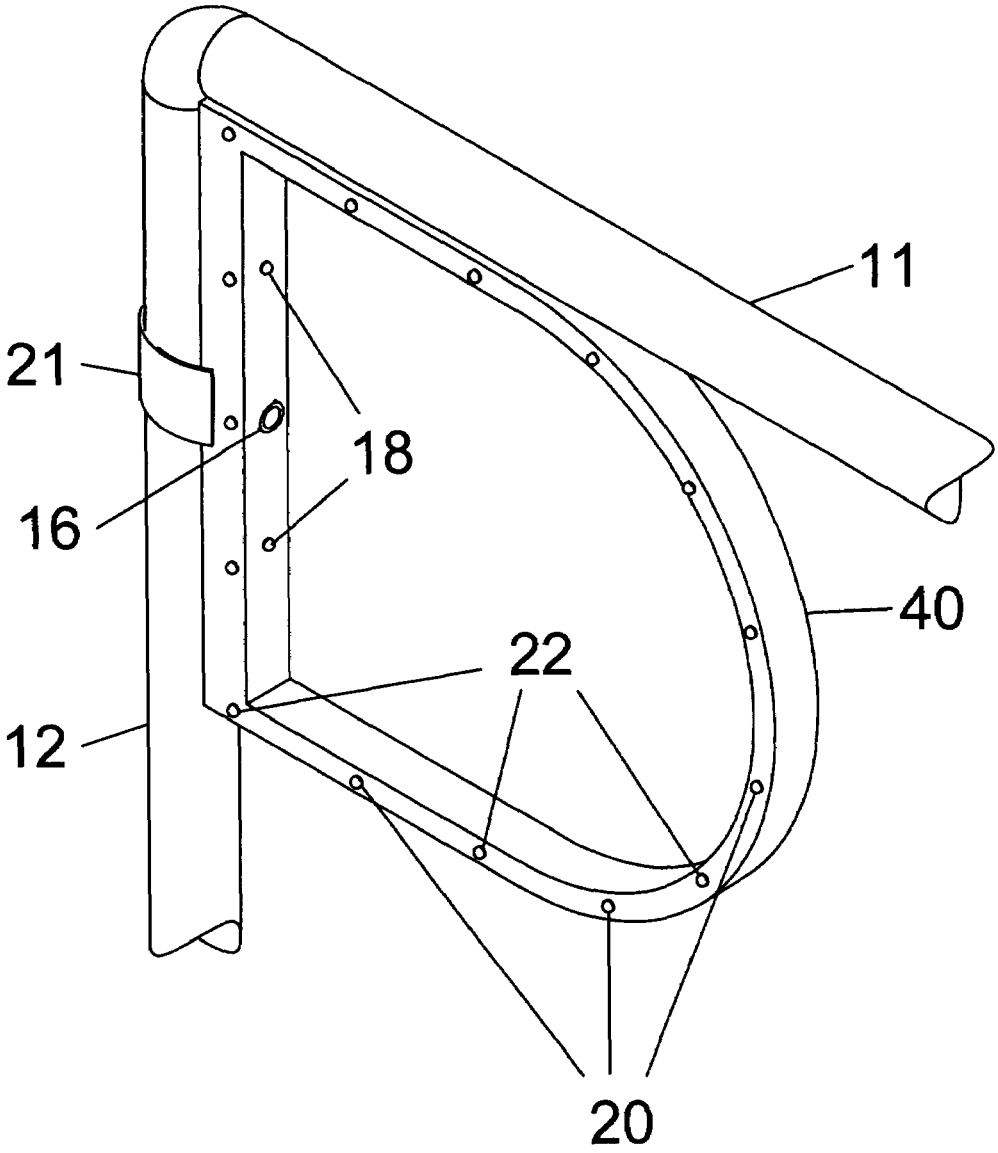
FIG. 6 shows an alternate embodiment for the shape of one target assembly.

Description—Alternative Embodiment—FIG. 6

FIG. 6 shows an alternate shape for the target 40. The shape consists of a 'U'-shaped segment with a vertical leg attached to the ends of the 'U' to provide a closed shape. The position of the infrared LEDs 18 and the infrared receiver module 16 are similar as in the preferred embodiment.

Operation—Alternative Embodiment—FIG. 6

The operation is the same as in the preferred embodiment, but the shape illustrated in FIG. 6 is better suited to shots that fall directly in the corners that may not be caught in the circular shape as described in the preferred embodiment. As in the preferred embodiment the infrared LEDs 18 are positioned such that they fill the target aperture with infrared light and the infrared receiver module 16 can detect the reflected infrared appropriately. Other shapes can be used as desired depending on the application.

Figure 7:
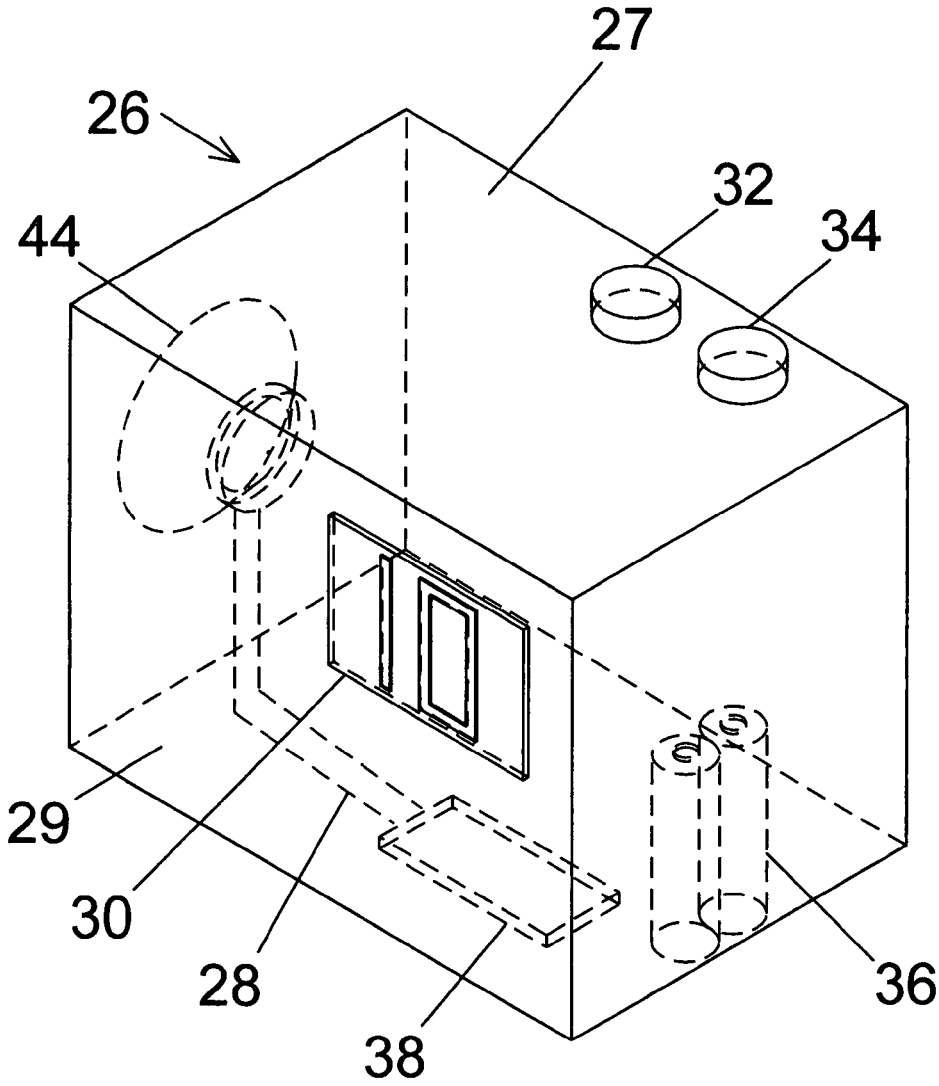
FIG. 7 shows an alternate embodiment with a speaker in the control unit.

Description—Alternative Embodiment—FIG. 7

FIG. 7 shows the main control unit 26 with a speaker 44 connected to the microchip 38 through wires 28.

Operation—Alternative Embodiment—FIG. 7

In another embodiment a speaker 44 can be added which is controlled by the microchip 38 to provide sound effects when a target 14 is scored on to add another interactive element. The microchip 38 can also be programmed to tell the user the current score through the speaker 44 or to add other sound effects as desired.

CONCLUSION, RAMIFICATIONS, AND SCOPE

Accordingly the reader will see that, according to one embodiment of the invention, the sports shooting practice system increases the proportion of time developing the skill in the sport as each target does not need to be reset after it has been scored on. It is flexible in the placement of the targets to allow focus on particular shooting areas. The targets attach to existing goal frames providing a consistent visual reference during practice as would be encountered in actual game play. It is also highly interactive as visual feedback is provided for the status of the target and the use of a microchip to control the target allows for many entertaining games to be provided.

While the above description contains many specificities, these should not be construed as limitations on the scope of any embodiment, but as exemplifications of the presently preferred embodiments thereof. Many other ramifications and variations are possible within the teachings of the various embodiments. Here are examples of these ramifications and variations:

- The targets can be made of steel or other alloy for even more impact resistance.
- Different projectiles can be used in place of the puck such as, but not limited to ball hockey ball, soccer ball, water polo ball, etc.
- The targets can be enlarged with the same principle design in mind for use in sports with larger goals such as soccer, handball, water polo, etc.
- The battery that provides direct current (DC) power can vary in size, number and type (rechargeable, long-life). An alternating current (AC) adapter can be used to provide this DC power instead.
- The red and green LEDs can be substituted with any other color and intensity as desired.
- The shape of the LEDs can also be modified to provide a different look to the targets.
- A goal light can be added behind the net similar to goal lights used in professional hockey.
- A remote control could be added to change the game being played and any other settings.

A dial that provides variable resistance can be added to modify the intensity of the LEDs as well as the loudness of the siren (if one is added).

Different timings for the flashing between the red and green LEDs can be used as desired.

A photo diode can be used to detect a change in the infrared signal instead of the infrared receiver module.

The detection mechanism can also use radar technology as an alternative, being able to detect the projectile passing through as well as the speed at which it passes.

Thus the scope of the invention should be determined by the appended claims and their legal equivalents, and not by the examples given.

The invention claimed is:

1. A sports shooting target assembly comprising:

a) a target frame shaped to define an aperture b) a means of electronically detecting a projectile passing through said aperture of said target frame c) said means of electronic detection comprising of one or more infrared light emitting diodes (LEDs) mounted to the target frame to fill said aperture with infrared light and one or more infrared receiver modules to detect said infrared light reflected from said projectile as it passes through said aperture d) a means of reducing the amount of said infrared light reflected from inner surface of said target frame e) said means of reducing the amount of said infrared light reflected from said inner surface of said target frame comprises of an infrared absorbing material applied to said inner surface.

2. The sports shooting target assembly of claim 1 further including a means of attaching said target frame to a post or crossbar.

3. The target assembly of claim 2 wherein said means of attaching said target frame comprises a saddle shape extending outward from said target frame and a releasable strap or hook-and-loop fastener to attach said saddle shape to said post or said crossbar.

4. The target assembly of claim 2 further including a plurality of colored lights mounted on a front face of said target frame.

5. A sports shooting practice system, comprising:

a) a plurality of said target assemblies of claim 4 b) a goal having a cross bar and two vertical posts c) said target assemblies attached to said cross bar or said vertical posts in desired practice locations d) a means of monitoring and controlling a state of said plurality of said target assemblies.

6. The sports shooting practice system of claim 5 wherein the means of monitoring and controlling said target assemblies comprises of wires connecting each said target assembly with a microcontroller chip, said microcontroller chip containing memory (ROM) and a suitable embedded program (PROM).

7. The sports shooting practice system of claim 6 further including a display unit.

8. A method of practicing sports shooting utilizing said sports shooting practice system of claim 7 with said method comprising a) said embedded program activating said target assemblies by lighting said colored lights b) said embedded program monitoring said activated target assemblies through said means of electronically detecting said projectile passing through said aperture of said target frame c) providing at least one said projectile d) shooting said at least one projectile through said aperture of one said target assembly e) said embedded program recording and displaying a score on said display unit f) said embedded program deactivating said color lights of said target assembly that was scored on.

* * * * *